US005114269A

United States Patent [19]

Shepherd

[11] Patent Number: 5,114,269

[45] Date of Patent: May 19, 1992

[54] VEHICLE MOUNTED DRUM ADJUSTABLE AGAINST A SURFACE

[76] Inventor: J. Harold Shepherd, 1840 River Forest Rd., N.W., Atlanta, Ga. 30327

[21] Appl. No.: 872,228

[22] Filed: Jun. 9, 1986

[51] Int. Cl.[5] ..... E01C 19/26

[52] U.S. Cl. ..... 404/122; 404/128

[58] Field of Search ..... 404/122, 128, 124

[56] References Cited

U.S. PATENT DOCUMENTS

| | | | |
|---|---|---|---|
| 3,260,179 | 1/1966 | Moreira | 404/128 |
| 3,768,583 | 10/1973 | Waterman | 404/122 X |
| 4,193,710 | 3/1980 | Pietrowski | 404/128 |
| 4,422,799 | 12/1983 | Tavernier | 404/128 |
| 4,523,873 | 6/1985 | Elliot | 404/124 |

*Primary Examiner*—David A. Scherbel
*Assistant Examiner*—Creighton Smith
*Attorney, Agent, or Firm*—Patrick F. Harry, Sr.

[57] ABSTRACT

A paving surface roller having indentation rumble strips comprising main pipe segments is mounted for support and operation on a frame structure of a paving machine or other vehicle and the drum is movable from operable to inoperable position above the surface by means of hydraulic rams attached to swinging arms on the frame. In one version the drum is supported and moved. In other versions for use with fixed drums, ground engaging wheels are selectively moved into place to elevate or lower the drum.

19 Claims, 4 Drawing Sheets

VEHICLE MOUNTED DRUM ADJUSTABLE AGAINST A SURFACE

The general area of subject matter is construction machinery and particularly a vehicle supported roller drum used on paved surfaces to make impressions or indentations thereon. The roller drum comprises main pipe segment beveled at the end to provide identations and is selectively raised or lowered against the surface In one form the vehicle is raised or lowered by contact members such as rubber-tired wheels and in another version only the drum is raised and lowered.

It is previously known in the field of construction of paved surfaces to employ a large roller drum having pipe segments around the periphery thereof beveled at the ends and for the purpose of making indentations or impressions in the paved surface. A bulletin of the Department of Transportation, State of Georgia, dated Feb. 15, 1984, and entitled "SPECIAL PROVISION SECTION 456-INDENTATION RUMBLE STRIPS" at 456.06 ILLUSTRATION: Not to Scale, discloses such a roller drum. Heretofore, such large, unwieldy and heavy drums have been operated and transported by whatever means and method is available at the moment. Disclosed herein is a means for raising and lowering the drum and one version comprises support arrangement for the roller drums for attachment to and detachment from a vehicle such as a paving machine. The support arrangement comprises a generally rectangular, vertically displaced frame on frame on which is mounted opposed, end support arms which are journaled to bearing arrangements on each of the respective ends of the drum. In other forms the power frame has ground contact members such as wheels that engage the ground and lift the drum or roller on that end.

Briefly described, in one embodiment the present invention comprises a conventional paving roller drum having indentation segments thereon, a support means for mounting said roller drum on one end of a vehicle, such as a paving machine, for attachment to and detachment therefrom, a means for rotatably supporting each end of the drum on said vehicle and said means comprising a respectove support arm swingably mounted on the support means, and a power lifting means such as hydraulic rams attached between the stationary support and the swinging arms for selectively moving the roller drum upwardly and downwardly into engagement with and disengagement from the paved surface. In another version, one end of a paving machine is provided with a wheel attachment selectively operable to be engaged with the ground to raise or lower the impression roller.

An object of this invention is to provide a means for supporting and operating a rumble strip roller drum on a vehicle together with a power means such as hydraulic rams for raising and lowering same so that the vehicle can travel with or without the drum against the surface and including versions that are usable with machines that have the drums and those that do not.

Another object of this invention resides in the particular manner for supporting and attaching a drum for raising and lowering on the front of a vehicle such as a paving machine whereby the entire apparatus including the drum may be easily installed and removed.

An additional object of this invention is found in the way the drum is supported and journaled on each end so that hydraulic rams may be operated from the machine to raise and lower the drum selectively in response to controls by the operator.

Other and further objects and advantages of this arrangement will become apparent upon reading a description of a preferred embodiment set forth in the accompanying drawings, in which.

DESCRIPTION OF A PREFERRED EMBODIMENT

Figure 1:
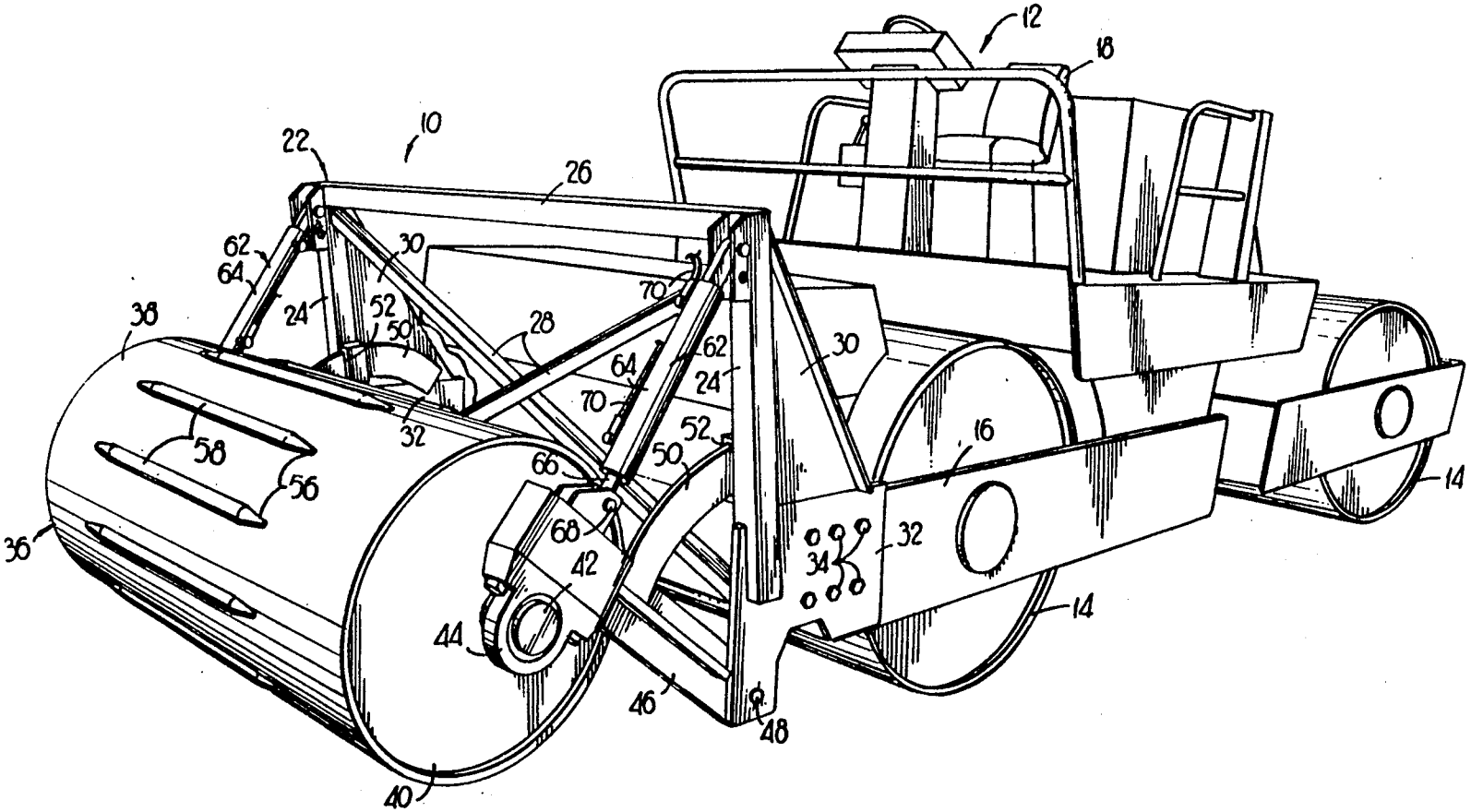
FIG. 1 is a perspective view of one version of the present device shown mounted on a typical paving vehicle illustrated in phantom lines.

The complete device 10 is shown in the drawing detachably mounted on the front of a typical paving machine 12 which comprises the usual ground contact rollers 14 on a chassis 16 on which is a driver's station 18 at which is located various controls for the operation of the machine. The machine 12 per se does not form any part of this invention and is one of many machines which could be used including trucks, bulldozers and other construction machinery.

The present device 10 comprises a support frame structure 22 which has vertical frame members 24 and horizontal frame members 26 braced by means of diagonal frame members 28. Vertical frame members are supported by side plates 30 and bottom plates 32 which are bolted to the front of the chassis 16 of the machine 12. Therefore, the entire apparatus of device 10 may be installed and removed at any time simply by lowering the drum into engagement with the ground surface and then removing bolts 34.

Roller drum 36 is of conventional construction having a cylindrical body 38 closed by end plates 40 each having a protruding stub axle 42 thereon. A typical journal box arrangement 44 is attached to each of the stub axles 42 and is attached and supported with a swinging arm 46 pivotally mounted on pivot 48 at each respective side of the bottom plates 32. Respective guide arms 50 are attached at one end to a respective swinging arm 46 and are confined for movement in a slot 52 on the vertical frame members 24 so as to guide and support the travel of the drum 36 from an upwardly inactive, deactive position above the ground surface to an activated condition against the ground surface 54.

As mentioned previously, the drum 36 is of conventional construction such as that set forth in the publication by the Department of Transportation, State of Georgia. Longitudinal protrusions 56 on the surface of the drum comprise main pipe segments which are centered and have beveled ends which are suitably reinforced and covered by a main pipe segment 58. The function and purpose of the drum 36 and the main pipe segments 58 is to make indentations in a paved surface as part of the process of surfacing a highway.

Drum 36 is raised and lowered with respect to the surface by means of hydraulic rams 62 mounted on opposite sides of the support frame structure 22 so that the cylinder 64 of each ram 62 is attached to the frame structure 22 near the top of the vertical frame members 24 and the piston rod 66 is attached to the housing of each respective journal box 44 by means of a pivot pin 68. Hydraulic lines 70 are coupled to each respective ram 62 in a typical manner of hydraulic connections and the lines 70 lead to a common control at the driver's station 18. The power from the hydraulic rams 62 is derived from a hydraulic pump on the machine 12 which supplies hydraulic fluid under pressure to each of the rams 62 thereby extending the respective rods 66, or retracting same as the case may be, so as to lower or raise the drum 36 selectively into operable engagement with the surface 54 which may be covered with asphalt.

Figure 2:
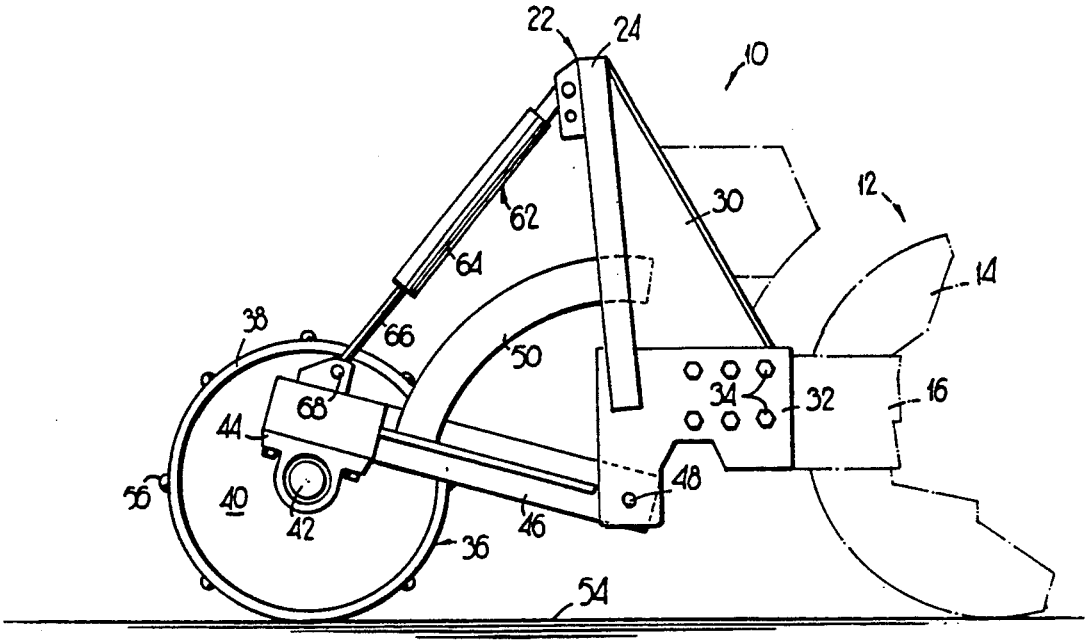
FIG. 2 is a side elevation view of the arrangement shown in FIG. 1.
Figure 3:
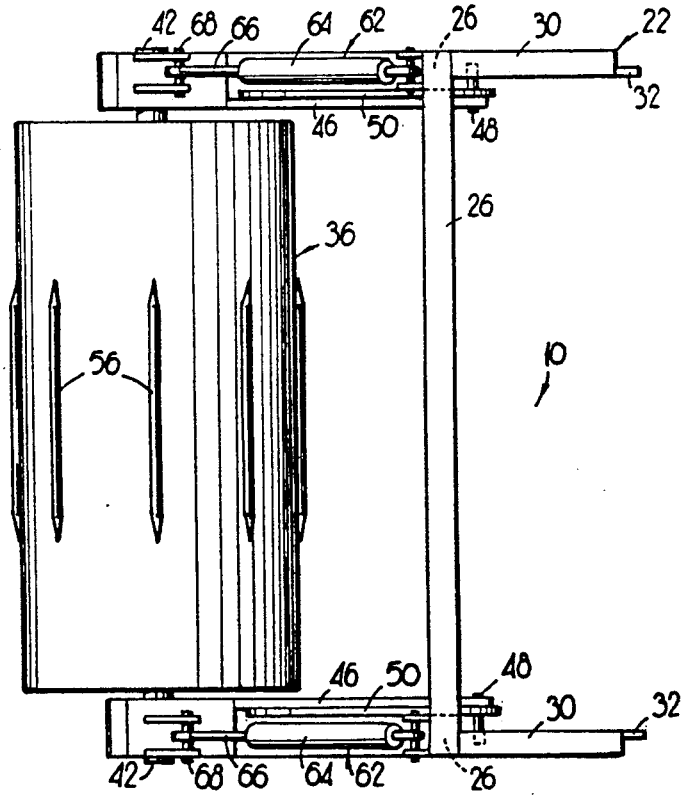
FIG. 3 is a top plan view of the arrangement shown in FIG. 1.
Figures 4, 7:
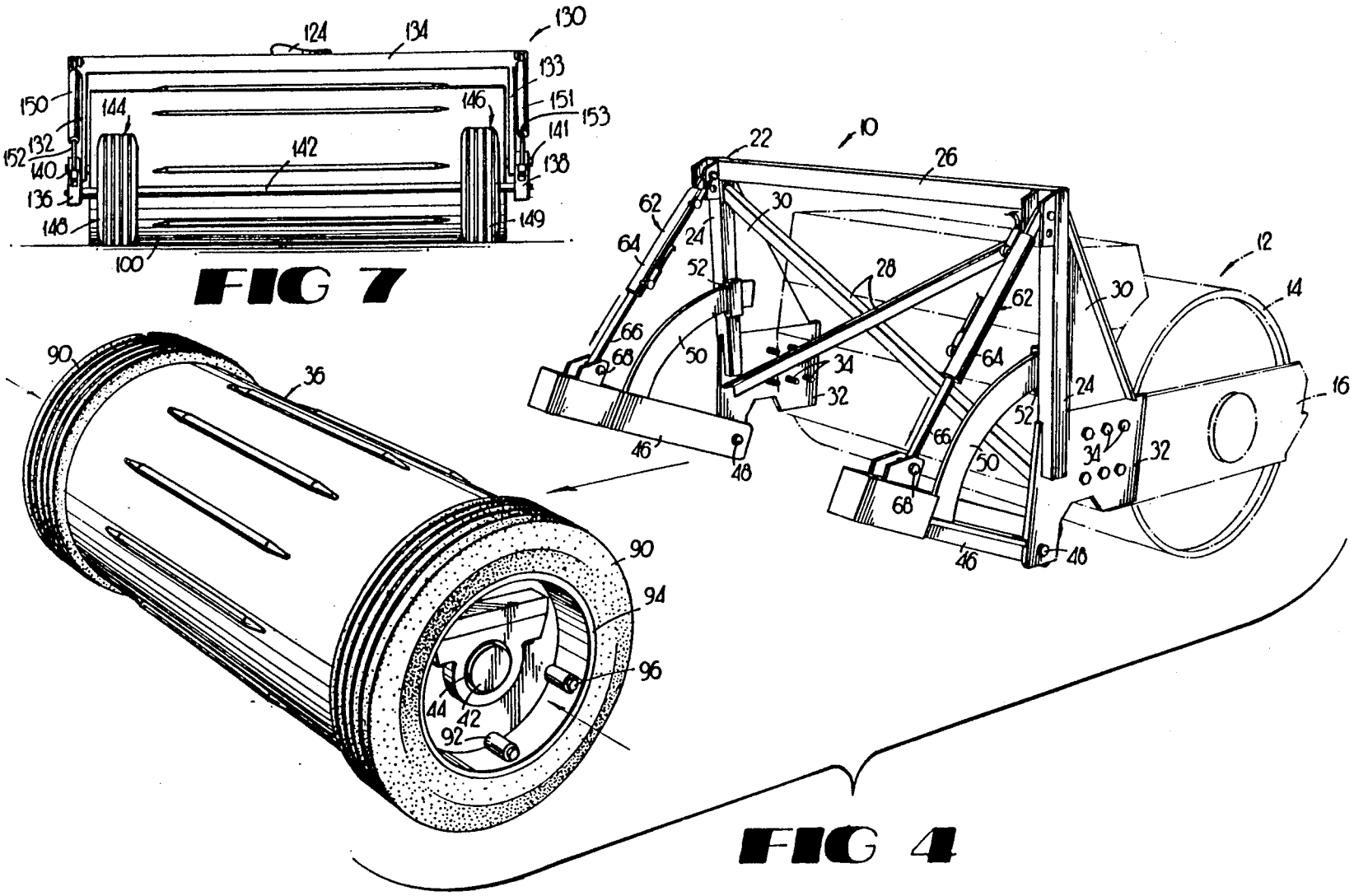
FIG. 4 is a perspective view of the arrangement shown in FIG. 1 with the drum removed and mounted on rubber-tired wheels.
FIG. 7 is a front elevation view of part of the machine shown in FIG. 6 with tires engaged against the ground surface.

As seen in FIG. 4, for the purpose of moving the drum 36 from one location to another when it is detached from the support frame structure 22, there is provided rubber-tired wheels 90 attached respectively to each of the stub axles 42 on each end of the drum 36 by means of bolt housings 92 on the rim 94 receiving lug bolts 96 screwed into the ends of the roller drum 36. This procedure and apparatus is not required and in no way affects the operation or use of the apparatus disclosed in the other figures of the drawings and described in the specification. The tires on wheels 90 can be deflated and left on the drum 36 in the use described in connection with FIGS. 1, 2 and 3 provided the axle 42 is modified by extension to accommodate the width of the tires which are completely compressed and deflated when roller drum 36 is pushed against the surface.

Figure 5:
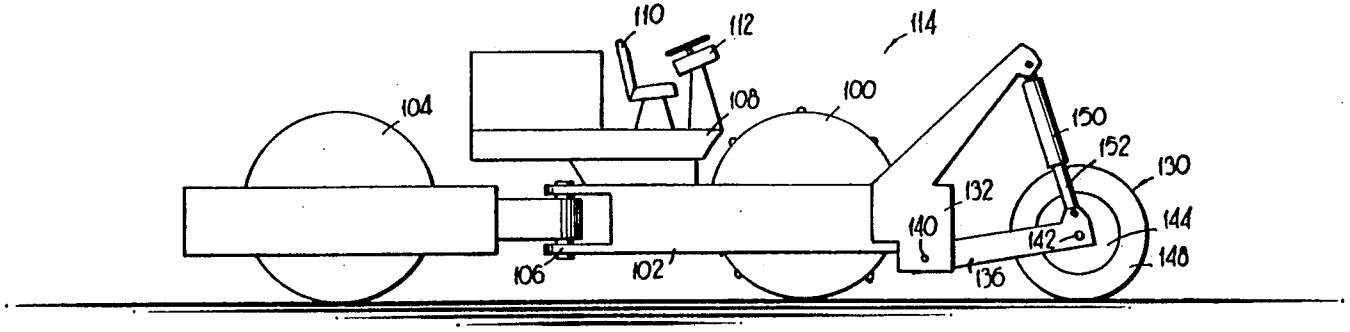
FIG. 5 is a side elevation view of a conventional roller machine having a power attachment mounted on the front for selectively elevating the front roller.
Figure 6:
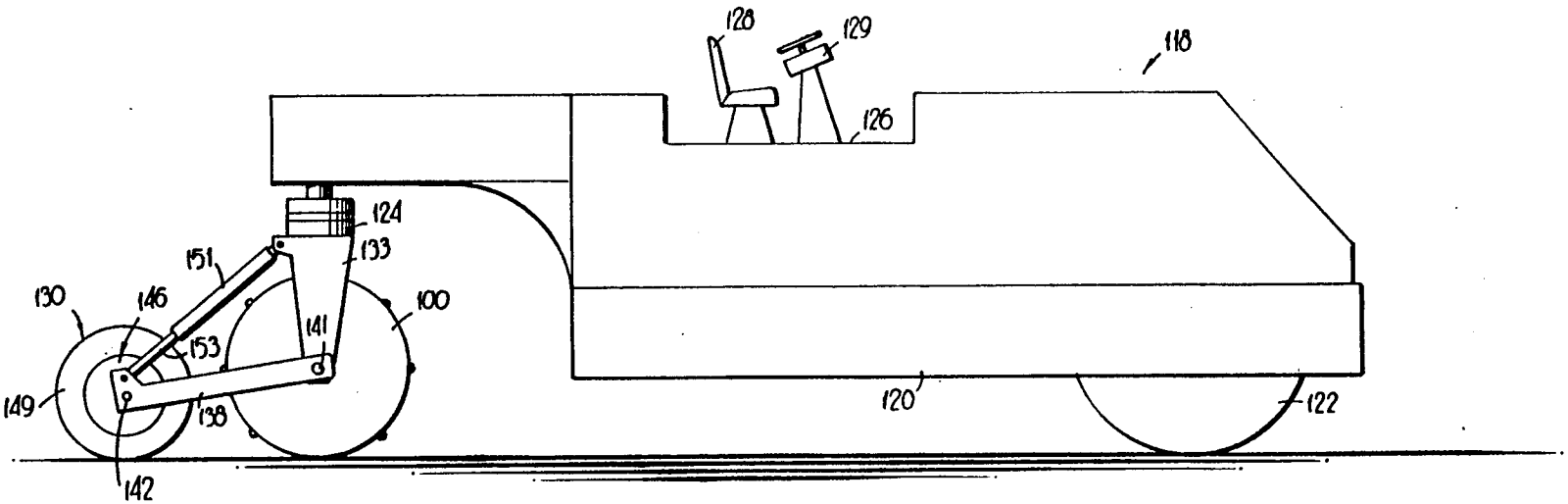
FIG. 6 is a side elevation view of a rear, pivoted roller machine with the power attachment of FIG. 5 mounted thereon.

In the modified version shown in FIG. 5 and 6, the impression roller 100 is a permanent part of the vehicle. In FIG. 5 the impression roller 100 is permanently mounted on chassis 102 having a rear drum 104 thereon pivotally mounted about a pivot arrangement 106. An operator's platform 108 contains an operator's chair 110 and various controls 112. This is conventional construction. The other conventional construction in a roller machine 118 as shown in FIG. 6 wherein the machine 118 comprises a chassis 120 on which is mounted a permanent front drum 122 and a pivotally mounted rear drum 100 which is mounted on a vertical pivot pin arrangement 124. There is an operator's platform 126, an operator's chair 128 and control 129.

Each of the conventional machines 114, 118 is provided with a means for selectively raising or lowering the impression roller 100 in the form of a wheeled attachment 130 which is symmetrical about a vertical axis in the center and comprises side plates 132, 133 connected by frame members 134 having a respective side arm 136, 138 pivotally mounted thereon on pivot 140, 141 and each arm 136, 138 has the outward end thereof mounted on an axle 142 on which are mounted respective wheels 144, 146 each having a heavy rubber tire 148, 149 thereon. A pair of hydraulic rams 150, 151 are mounted on opposite sides near the top of the plates 132 and have the piston rod 152, 153 of each thereof connected to a respective arm so that the operation of the ram 150 will raise or lower the wheels 144, 146 bringing the tires 148, 149 into engagement or selective disengagement with the ground thereby raising or lowering the impression roller 100 sufficiently to engage or disengage same from operation against the ground. This is very useful in moving the respective machines from one location to another without engaging the impression roller 100 on the ground and of course may be used with paving machines and the like which already have an impression roller 100 permanently built into the machine or an impression roller surface can be easily modified without changing the roller 100. Each of the pavers 114, 118 can be steered somewhat in the normal fashion by moving the usual pivot pin arrangement 106 or 124.

While I have shown and described a particular embodiment of this invention together with a means for moving the drum around, this is by way of illustration only and does not constitute the only form of the invention since various alterations, changes and deviations may be made within the scope of the invention as defined by a proper interpretation of the appended claims.

What is claimed:

1. In a paving vehicle for selectively making indentations on a surface:

paving means on said vehicle for supporting same during paving movement over the surface, a roller drum on said vehicle comprising means for making indentations when engaged against the surface such as asphalt and the like, means on said vehicle selectively for raising and lowering said roller drum relative to the surface, and means for supporting said vehicle for movement over the surface when said drum is in raised position.

2. The device in claim 1 including a support frame mounted on the end of said vehicle for removal therefrom, said support frame comprising vertical frame members, a respective support arm movably mounted at opposite sides of said frame on opposite sides of said vehicle and means on said support arms for rotatably supporting a respective end of said drum thereon, and power means on said frame for raising and lowering said drum.

3. The device claimed in claim 2 wherein said arms being provided with a guide member for guiding a respective arm on said frame when raising or lowering said drum.

4. The device claimed in claim 2 wherein there are at least two hydraulic cylinders attached on opposite sides of said frame adjacent opposite ends of said roller drum.

5. The device claimed in claim 3 wherein each of said arms has a journal thereon rotatably supporting a respective member on the respective end of the drum.

6. The device claimed in claim 2 wherein said support frame structure comprises vertical frame members, horizontal frame members and diagonal frame members and there being plates on each side of said frame attached to said vertical frame members.

7. The device claimed in claim 3 wherein there is a slot in each end of the frame and said guide member travels in said slot when said arm is raised or lowered.

8. The device in claim 1 wherein said means for supporting said vehicle comprises a frame support, wheels on said frame support engageable with the surface when said drum is elevated and power means on said vehicle for moving said frame support.

9. The vehicle in claim 3 wherein said roller drum is fixed for rotation on the front of said vehicle and said support frame is mounted in front of said drum on the front of said vehicle.

10. The vehicle in claim 8 wherein said roller drum is mounted for rotation on the rear of said vehicle for steering said vehicle, and said frame support is mounted at the rear of said drum.

11. In a vehicle:

an impression roller drum of one end of said vehicle and a ground support means on the other end thereof, means on said vehicle for selectively raising and lowering said drum with respect to the ground surface so as to engage and disengage the operation of said drum on said surface, said means comprising a power frame on said vehicle and power means on said frame, 12. In a vehicle:

an impression roller drum *on* one end of said vehicle and a ground support means on the other end thereof, means on said vehicle for selectively raising and lowering said drum with respect to the ground surface so as to engage and disengage the operation of said drum on said surface, said means comprising a power frame on said vehicle and power means on said frame, 13. In a vehicle:

an impression roller drum *on* one end of said vehicle and a ground support means on the other end thereof, means on said vehicle for selectively raising and lowering said drum with respect to the ground surface so as to engage and disengage the operation of said drum on said surface, said means comprising a power frame on said vehicle and power means on said frame, 14. The vehicle in claim 11 wherein the power means comprises at least two hydraulic piston and cylinder units operable between the vehicle and the wheels to raise and lower same.

15. The vehicle in claim 14 wherein said wheels are supported on a transverse axle therebetween, arms on opposite sides of said frame support connected to said axle, said hydraulic units being attached to said arms adjacent opposite ends thereof.

16. In a vehicle:

an impression roller drum *on* one end of said vehicle and a ground support means on the other end thereof, means on said vehicle for selectively raising and lowering said drum with respect to the ground surface so as to engage and disengage the operation of said drum on said surface, and means comprising a power frame on said vehicle and power means on said frame, 17. The vehicle in claim 16 wherein each of said wheels is removable from the end of said drum whereby said drum may be supported on said vehicle without the wheels thereon.

18. In a vehicle:

an impression roller drum on one end of said vehicle and a ground support means on the other end thereof, means on said vehicle for selectively raising and lowering said drum with respect to the ground surface so as to engage and disengage the operation of said drum on said surface, said means comprising a power frame on said vehicle and power means on said frame, a support frame mounted on the end of said vehicle for removal therefrom, said support frame comprising vertical frame members, a respective support arm movably mounted at opposite sides of said frame on opposite sides of said vehicle, means on said support arms for rotatably supporting a respective end of said drum thereon, power means on said frame for raising and lowering said drum, said support frame structure comprising vertical frame members, horizontal frame members and diagonal frame members and there being side plates on each side of said frame attached to said vertical frame members.

19. In a vehicle:

an impression roller drum *on* one end of said vehicle and a ground support means on the other end thereof, means on said vehicle for selectively raising and lowering said drum with respect to the ground surface so as to engage and disengage the operation of said drum on said surface, and means comprising a power frame on said vehicle and power means on said frame,

* * * * *